United States Patent [19]

Kummerow et al.

[11] 4,206,335

[45] Jun. 3, 1980

[54] LOW VOLTAGE CIRCUIT BREAKER HAVING A TWO PART INSULATING HOUSING

[75] Inventors: Gerd Kummerow; Klaus-Günther Berndt; Bernhard Preuss; Werner Troebel, all of Berlin, Fed. Rep. of Germany

[73] Assignee: Siemens Aktiengesellschaft, Berlin and Munich, Fed. Rep. of Germany

[21] Appl. No.: 964,635

[22] Filed: Nov. 29, 1978

[30] Foreign Application Priority Data

Dec. 9, 1977 [DE] Fed. Rep. of Germany ..... 2755567

[51] Int. Cl.[2] ..... H01H 9/02

[52] U.S. Cl. ..... 200/303; 361/428

[58] Field of Search ..... 200/293, 296, 303; 335/18; 174/58, 65 R, 59, 60; 361/353, 355, 428

[56] References Cited

U.S. PATENT DOCUMENTS

| | | | |
|---|---|---|---|
| 2,659,792 | 11/1953 | Boardman | 200/303 X |
| 2,681,964 | 6/1954 | Rodden | 200/303 X |
| 2,881,279 | 4/1959 | Taylor | 200/296 X |
| 2,908,782 | 10/1959 | Kiesal et al. | 200/303 X |
| 3,041,504 | 6/1962 | Lacan | 361/428 |
| 3,617,612 | 3/1971 | Patton | 174/65 R X |

*Primary Examiner*—Stephen Marcus

*Attorney, Agent, or Firm*—Kenyon & Kenyon

[57] ABSTRACT

A low voltage circuit breaker having a housing of insulating material separated into an upper part and a lower part. A slot is provided one side wall of the lower part beginning at the parting line and extending to the lower edge of the lower part in which wires leading to an auxiliary device can be installed. An outlet is provided at the separation for these wires. The slot makes it possible to arrange several identical low voltage circuit breakers with connected auxiliary wires directly next to each other.

6 Claims, 9 Drawing Figures

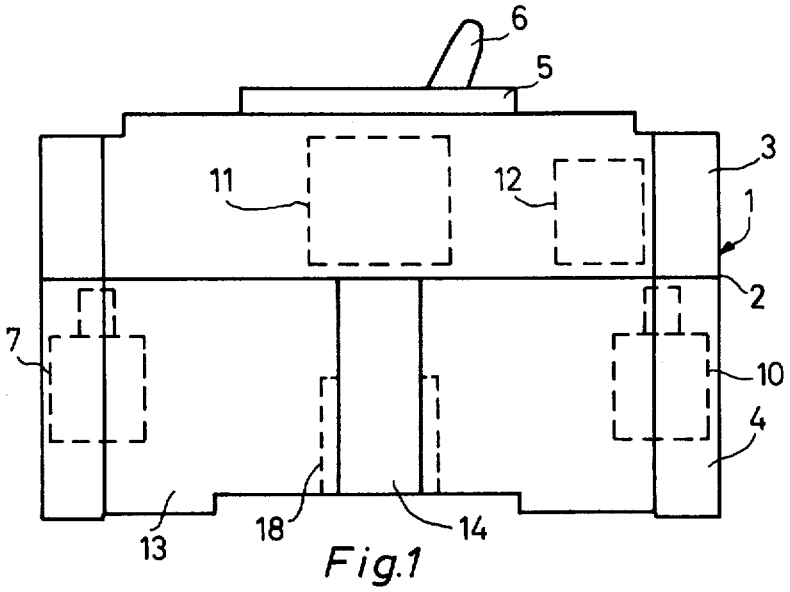
Fig.1
Fig.3
Fig.2
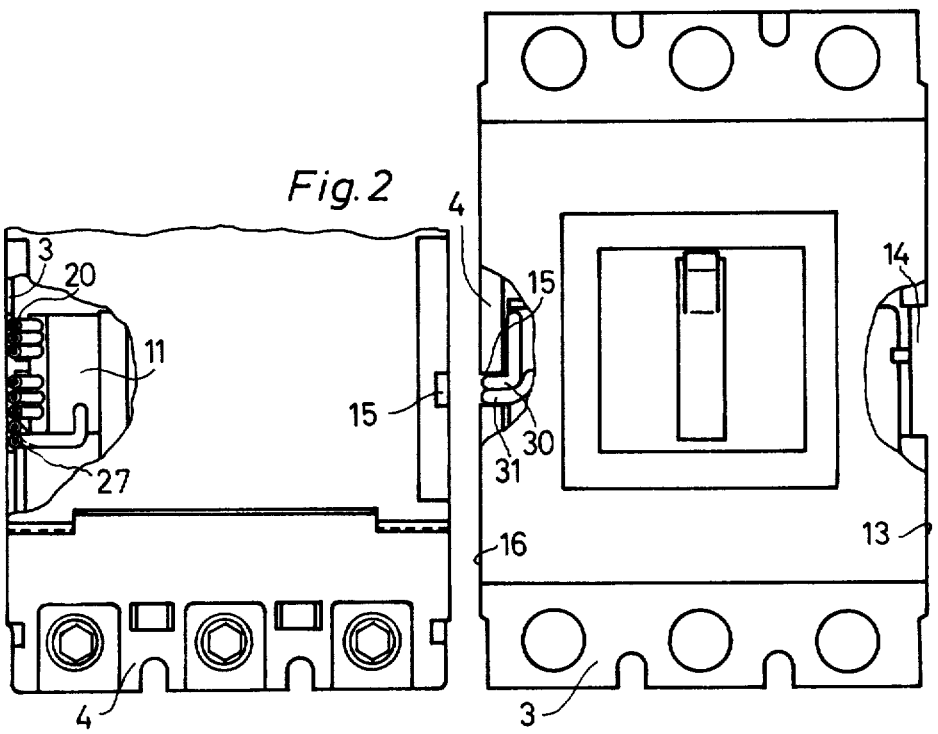

LOW VOLTAGE CIRCUIT BREAKER HAVING A TWO PART INSULATING HOUSING

BACKGROUND OF THE INVENTION

1. Field of the Invention

This invention relates to low voltage circuit breakers having a housing of insulating material divided into upper and lower parts and including at least one auxiliary device which can be mounted inside the housing and can be connected by wires to apparatus located outside the housing.

2. Description of the Prior Art

A breaker of this type is described in publication TN 2453 4-1972 of the firm Sace. Auxiliary devices to be used with it are, for example, switches for auxiliary circuits, operating current tripping devices, undervoltage tripping devices, and so-called alarm switches which signal the automatic tripping of the breaker. Little space is available to accommodate these devices in the insulating housings. When it is done, they are usually located in the vicinity of the lateral pole paths in the upper part of the housing, but sometimes they are also in the lower part. This raises the problem of bringing the connecting lines of these auxiliary devices out in an orderly manner.

It is an object of this invention to provide means for running the auxiliary wires at and in the breakers so that, on the one hand, a distance as large as possible from the main current paths is obtained and, on the other hand, no special consideration of the auxiliary wires is necessary when the circuit breaker is installed in a distribution board.

SUMMARY OF THE INVENTION

According to the present invention, the above problem is solved by providing in at least one side wall of the lower part of the insulating material of the housing a channel-like slot which begins at the housing parting line and extends to the lower edge of the housing, and by providing an outlet for the wires to be connected to the auxiliary device at the parting gap. With this arrangement, the wires leave the housing of insulating material in the region of the upper part of the housing, i.e., at a distance from the main current paths. Although the wires now leave the insulating housing laterally, several breakers can be mounted next to each other without space between them because the slots in the lower housing parts form a wiring channel through which the wires lead to the backside surface of the mounted breakers. There, the wires can be inserted into a wiring channel or a protective conduit in the usual way.

In a further embodiment, the slot provided at the side wall of the lower part of the insulating housing is provided with an undercut on at least one of its lateral flanks. A mounting arm for supportive a terminal strip or a bracket of sheet metal, plastic or another material can then be placed in the slot. The connecting wires of the auxiliary devices can be connected to the terminal strip if the breakers are mounted individually or in small groups. The undercut may have any suitable profile such as, for instance, rectangular or dovetail.

A friction fit, as can be achieved by suitable design of the parts, is, in principle, sufficient for fastening the terminal bracket. However, according to another aspect of the invention, the undercuts are provided with a step behind which the legs to be inserted in the terminal bracket can engage. Furthermore, the arrangement is made self locking by means of sharp edges on the shoulder and on the end of the leg. The leg may also have a lteral spring tab which makes contact behind the step of the undercut.

In accordance with another teaching of the invention, the slot provided at a side wall of the circuit breaker has a width appropriate to the number of auxiliary wires required. In still another feature of the invention two narrower slots parallel to each other are provided instead of one wide slot so that the wires leading to two auxiliary devices can be brought out of the housing separately.

Also provided by the invention is an advantageous means for fastening a terminal bracket consisting of a detent step in the vicinity of the slot or slots. There are two parallel slots arranged at the side wall between the slots. The detent step, which may be made in the form of a depression or a shoulder, serves to automatically secure the terminal bracket when it is inserted into the slots, by letting a leg, which is preferably resilient, lock or snap in.

It is also advantageous to provide a slot on the underside of the lower part of the insulating housing in a manner known in the art. Auxiliary wires can be run in such a slot from one side of the lower part to the other or to an adjacent breaker.

BRIEF DESCRIPTION OF THE DRAWINGS

FIG. 1 is a side view of a low voltage circuit breaker, encapsulated in insulating material, embodying the teachings of the invention.

FIG. 2 is a view of the bottom of the breaker of FIG. 1 with a side wall partially broken away to show the bottom of the top part.

FIG. 3 is a top view of the breaker of FIG. 1 with portions of the top part broken away to show the top plane of the bottom part.

DETAIL DESCRIPTION OF THE INVENTION

Figure 4:
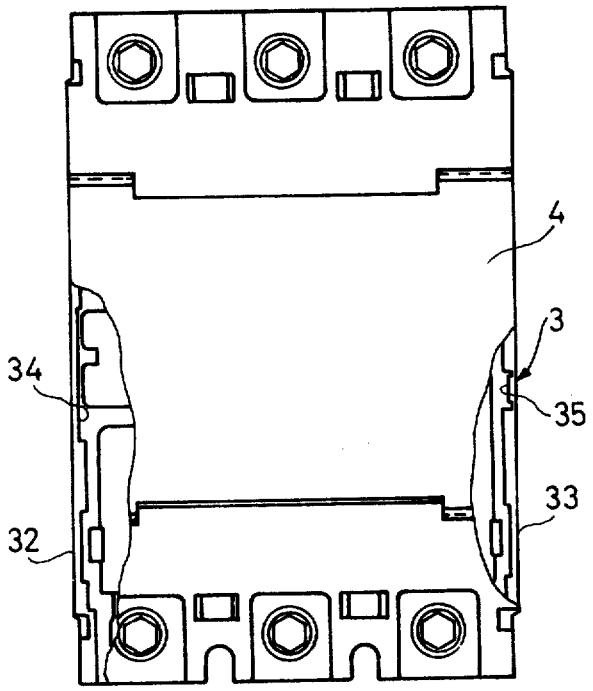
FIG. 4 is a bottom view of the breaker of FIG. 1 with portions cut away to show the parting plane of the upper part of the insulating housing.

The low voltage circuit breaker shown in FIG. 1 comprises an insulating material housing 1 of thermoplastic or thermosetting molding material such as a polyester resin with filler added. Housing 1 is divided along a parting line 2 and therefore has an upper part 3 and a lower part 4. A hand lever 6 for switching the breaker on and off protrudes from a central pedestal 5 of the upper part 3. The terminals for the incoming and outgoing wires are shown by dashed lines as schematically simplified areas 7 and 10. In FIG. 1, also shown dashed, are, in the area of the upper housing part 3, auxiliary switch 11 and operating current tripping device 12. Depending on the desired functions and the space available in the upper part 3 and in the lower part 4, one auxiliary device or two or more auxiliary devices may be provided.

The connecting wires of the auxiliary switch 11, mentioned as an example of an auxiliary device, and of the operating current tripping device 12 can be brought out from the insulating material housing 2 at the parting gap 2. For this purpose, a slot 14 which begins at the parting line 2 and extends to the lower edge of the lower part 4, is provided in the sidewall 13 of the lower part 4. Another, narrower slot 15 is provided in the opposite side wall 16 (FIG. 3).

FIG. 2 shows the outline of the auxiliary switch 11 and the wires 20 to 27 connected thereto which approximately fill the width of the slot 14. The depth of the slot is made so that the wires do not project beyond the contour of the housing. It is evident from FIG. 3 that the further slot 15 is designed according to the width of two auxiliary lines 30 and 31.

The upper portions of the slots are covered by the upper part of the insulating material housing 1. The side walls in the vicinity of the slots are therefore cut away in such a manner that recesses are created which form outlets for the wires. This is shown in the view from the bottom, showing the recesses as cut away portions of the upper part 3 (FIG. 4). The recesses in the side walls 32 and 33 are there designated 34 and 35.

Figure 5:
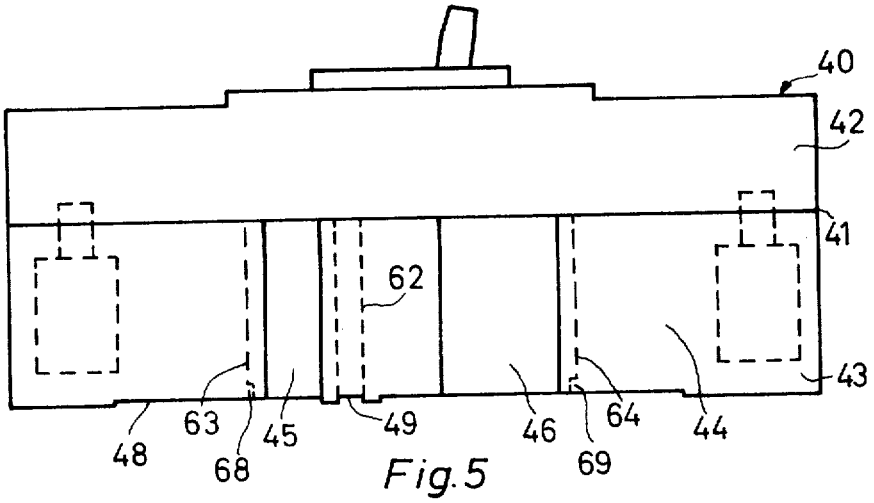
FIG. 5 is a side view of another embodiment of the invention.
Figure 6:
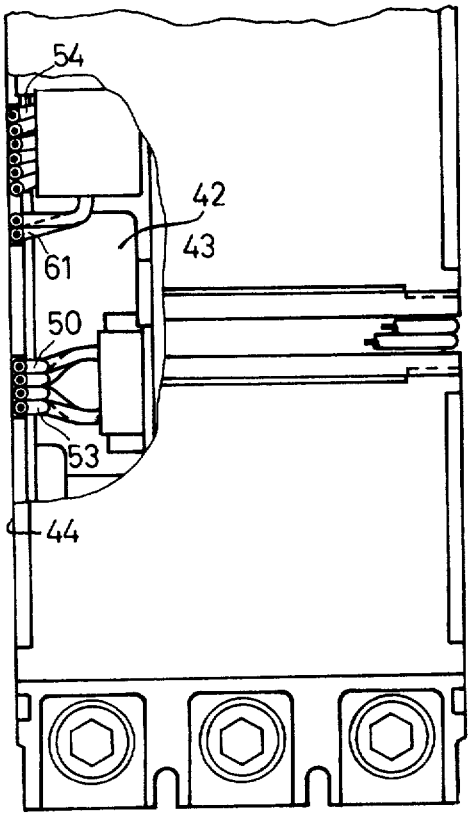
FIG. 6 is a bottom view of the breaker of FIG. 5 with a side wall partially broken away.

FIG. 5 shows another circuit breaker having a housing 40 of insulating material which is likewise devided into an upper part 42 and a lower part 43 by a parting 41. In the side wall 44 of lower part 43 there are parallel slots 45 and 46 of different width. In this way provision is made for bringing out of the insulating material housing 40 at the side wall 44 not only the connecting wires of an auxiliary switch, but, physically separated therefrom, the connecting wires of another auxiliary defvice, as shown in FIG. 6. There, the wires to be run in the narrower slot 45 are numbered 50 to 53 and the wires to be run in the wider slot are numbered 54 to 61.

Figure 7:
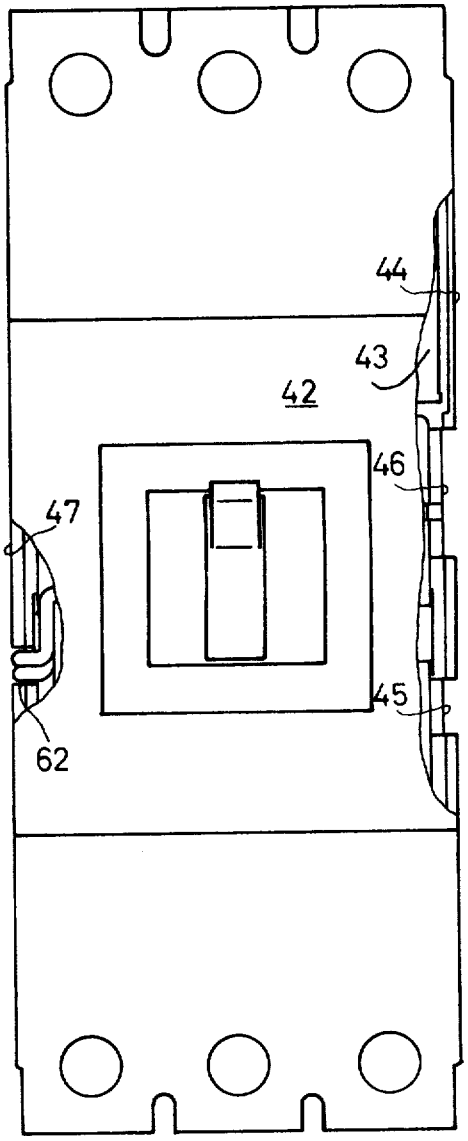
FIG. 7 is a top view of the breaker of FIG. 5 with portions broken away to show the lower part.

The side wall 47 opposite to side wall 44 is likewise provided with a slot 62 (FIGS. 6 and 7), having the dimensions and capacity for wires of the slot 15 shown in FIG. 3 above.

Figure 8:
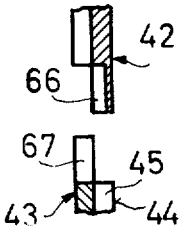
FIG. 8 shows a broken out cross section through the side walls in the vicinity of the parting gap of the breaker of FIG. 5.

In distinction from the first embodiment shown, the side wall of the upper part 42 as well as the side wall 44 of the lower part 43 have recesses 66 and 67, respectively (FIG. 8). Recess 66 is formed in overlapping wall 42, being produced by reducing the thickness of wall 42 on the inside; recess 67 is made by cutting away the opposing part of wall 43 adjacent to outer slot 45.

Figure 9:
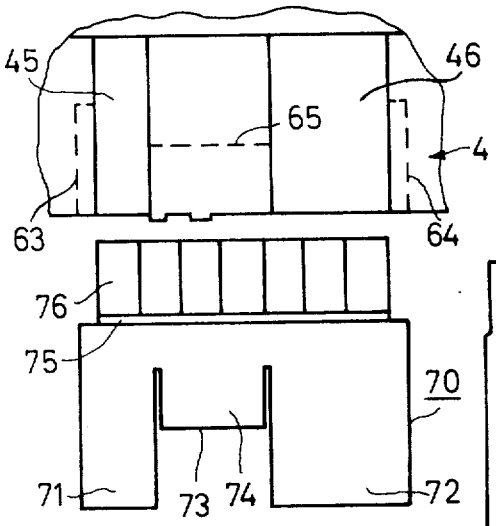
FIG. 9 illustrates a terminal bracket which can be attached at the side walls of circuit breakers according to the teachings of the invention.

Many modifications of the arrangement of the slots are possible for accommodating different numbers of wires to be brought out and for different locations of auxiliary devices within the insulating housing of the breaker. In addition, the slots can be used for fastening a terminal bracket. To this end, one or all slots arranged in the side walls of the lower parts can be provided, at least over part of their height with an undercut 18, as is shown dashed in FIG. 1. The undercut may have any desired shape, for example, a rectangular or also angular, i.e., dovetail profile. Before the housing is fastened on its support, a suitably shaped sheet metal or plastic part can be inserted into the slot from below, which is provided with a space at right angles for fastening a terminal strip. The breaker of FIG. 5 also has two parallel slots which can serve jointly for fastening a terminal bracket. For this purpose, an undercut 63 can be provided at least at the left flank of slot 45 and an undercut 64 at the right flank of slot 46, so that a terminal bracket can slide in (FIGS. 5 and 9). If a detent step 65 (FIG. 9) is provided in the side wall between the slots 45 and 46, then automatic locking of the terminal bracket 70 is taken care of (FIG. 9). This terminal bracket is inserted with its legs 71 and 72 into the slots 45 and 46, the edges of the legs 71 and 72 engaging the undercuts 63 and 64. In the end position, the bent portion (not shown) of the edge 73 of a central spring tab 74 is placed behind the detent step 65 and thereby locks the terminal bracket 70. A terminal strip 76 is fastened to the bent over leg 75.

The undercuts in the flanks of the slots may extend fully or partially over the length of the slots. They may furthermore be provided with lateral steps 68 and 69, respectively (FIG. 5), which likewise serve to retain a terminal bracket. It is sufficient if the steps 68 and 69 and the lower edge of the legs 71 and 72 of the bracket 70 are made with sharp corners. However, it is also possible to provide cuts in these legs to form spring tabs which snap in behind the steps 68 and 69. The center tab 74 is then not required.

In those circuit breakers which must sit on a mounting surface, and must therefore have substantially flat undersides, as shown in FIG. 5, it is advantageous to arrange a further slot 49 in the underside 48 for running wires, in correspondence with at least one of the slots provided in the side walls. Thus the slot 49 of FIG. 5 leads into the slot 62 in the side wall 47.

What is claimed is:

1. In a low voltage circuit breaker comprising a housing of insulating material consisting of an upper part and a lower part and at least one auxiliary device arranged within the housing which can be connected by wires to switching apparatus located outside the housing, the improvement comprising:

at least one sidewall of the lower part of the housing having a slot for receiving the wires so that they do not project beyond the side contour of the housing, the slot starting at the parting of the housing and extending to the lower edge of the lower part; and an outlet in a wall of the housing at the parting for passage of wires from the slot to be connected to the auxiliary device.

2. A low voltage circuit breaker in accordance with claim 1, comprising the further improvement that at least one of the lateral flanks of the slot has an undercut for receiving a bracket.

3. A low voltage circuit breaker in accordance with claim 2, in which the undercut has a step.

4. A low voltage circuit breaker according to claim 1, wherein two slots are disposed parallel to each other in at least one side wall.

5. A low voltage circuit breaker according to claim 1 or 4 in which the side wall is provided with a detent step adjacent at least one of the slots.

6. A low voltage circuit breaker according to claim 1 wherein the underside of the lower part of the insulating material housing has a slot which corresponds with a slot provided in a side wall.

* * * * *